United States Patent [19]

Minkle

[11] Patent Number: 4,580,773

[45] Date of Patent: Apr. 8, 1986

[54] SHEET-SEEKING SUCTION FOOT FOR COMBINED SHEET SEPARATION AND FORWARDING IN A SMALL PRINTING PRESS

[76] Inventor: Richard Minkle, 4933 N. Emerald, La Verne, Calif. 91750

[21] Appl. No.: 627,273

[22] Filed: Jul. 2, 1984

[51] Int. Cl.[4] ..... B65H 3/08

[52] U.S. Cl. ..... 271/103; 271/107

[58] Field of Search ..... 271/103, 107

[56] References Cited

U.S. PATENT DOCUMENTS 2,341,521 2/1944 Baker et al. ..... 271/103

FOREIGN PATENT DOCUMENTS 716791 10/1954 United Kingdom ..... 271/103

*Primary Examiner*—Bruce H. Stoner, Jr.
*Assistant Examiner*—Matthew C. Graham
*Attorney, Agent, or Firm*—Peter I. Lippman

[57] ABSTRACT

This suction foot or "sheet sucker" has a cylinder and a hollow piston fitted in the cylinder. The piston has a piston rod whose tip protrudes downwardly from the cylinder to apply suction to the top sheet of stock in a small press. The cylinder is supported from and moved by a hollow support rod that is connected with the suction system of the press. The piston and rod are spring-loaded upward relative to the cylinder. The hole in the support rod communicates with a point in the cylinder cavity below the piston. Applied suction consequently draws the cylinder and rod downward, against the spring action, in effect telescoping the suction foot tip outwardly toward the stock. When a sheet of stock closes the bottom end of the hollow piston and rod, pressure on the cylinder is equalized and the suction foot tip retracts, raising the stock for travel into the press. The necessary air communication is effected by several fine air passageways in the cylinder side wall and top wall.

7 Claims, 6 Drawing Figures

SHEET-SEEKING SUCTION FOOT FOR COMBINED SHEET SEPARATION AND FORWARDING IN A SMALL PRINTING PRESS

BACKGROUND

1. Field of the Invention

This invention relates generally to printing-press equipment, and more particularly to a "suction foot" or "sheet sucker" used in small presses to separate the top piece of stock (paper, cardboard, etc.) from a pile and to forward that top piece into the press proper.

2. Prior Art

There are basically three known forms of suction foot for a printing press. The first is simply a cut-off hollow rod, attached at the top to a suction system tnat is part of the press (or is added later). Attached to the bottom tip of the rod there is usually a soft rubber or plastic hood that droops slightly onto the stock to enhance the suction effect between the tip of the rod and the stock.

Such a foot is moved by the press mechanism in such a way that it slightly lifts the top sheet of stock from the supply pile, or moves the top sheet forward after it has been lifted, or both. In the printing craft the lifting process is generally called "separation"; the forward motion, which moves the sheet into a position where it can be pulled along by rollers in the press, is generally called "forwarding".

Simple cut-off rods are problematical in that they must be positioned very carefully for each project (and for each sheet), to apply suction effectively without punching holes or indentations into the stock. This is particularly difficult since the height of the pile of stock changes continuously during operation of the press, and the servocontrolled stock elevator cannot perform perfectly.

Cut-off rods are also troublesome because they tend to compress the top of the pile slightly, pushing air out of the pile. Effective separation requires ready access of air under each of the top few sheets—to push the top sheet upwardly, while the suction system removes the downward pressure normally presented by air above the top sheet.

Nevertheless, such suction feet are used widely in small presses for their extreme simplicity and low cost—but most particularly because they do not take up much room. The simple rod-type foot does not extend horizontally toward the pullout rollers, various crossbar mounts, or side guides and side walls in the rather cramped quarters within a small press, and its suction hose extends vertically, up out of the way of these various other components.

Hence design efforts have been concentrated in providing adjustments for the rod-type suction foot, relative to the top of the supply pile, that are as accurate as such things can economically be. Such adjustments sometimes require considerable "fussing" by the press operator at the beginning of each project, and continual vigilance to be certain that the stock is not being damaged by drift of the adjustment, or by excessive dead zone in the elevator servosystem.

A second generation of suction foot is known as the "compensating foot" or, more affectionately, "compensating sucker". The compensating type has a vertical cylinder, with a hollow internal piston and rod that are within the cylinder and are spring-loaded downwardly relative to the cylinder. At the lower tip of the piston rod there is of course a floppy hood as before. At the top of the cylinder is a hollow support rod (similar to the cut-off rod foot) that is attached to the suction system of the press. The hole in the support rod communicates directly witn the space above the piston, and hence communicates with the hole through the piston and rod.

In operation the compensating sucker is lowered by the press mechanism toward the pile of sheets, if it is being used for separation. If the sucker is being used for forwarding only, a sheet is raised toward the compensating sucker. In either case, before the solidly supported cylinder hits the top sheet, the downwardly spring-loaded piston-rod tip engages the sheet, closing the end of the air passage. The suction now becomes effective to hold the sheet of stock up against the tip, but with much less fussiness of adjustment since the tip may engage the sheet anywhere within the piston stroke.

For the compensating sucker to work well in a separating mode, however, it is also necessary for the suction system to draw the piston upward within the cylinder. In other words, once the sheet of stock has closed off the bottom of the piston-rod tip, the dead air space within the piston and piston rod act almost as if they were part of the piston. The situation is theoretically as if the piston were solid, and the suction applied above the piston should retract the tip. In theory the sheet is thus raised from the top of the pile.

In practice these devices are unreliable, because the suction force for retraction is opposed both by the spring and by gravity. The pressure differential available from a typical suction system often varies in operation, and especially with age; and the weight of a sheet of stock varies substantially. Small pieces of dirt and the like can increase stiction in the system, making matters worse.

The overall result is unreliable retraction. In addition the compensating sucker if used for both separation and forwarding often drags on horizontal return, damaging or marking the next sheet. Furthermore, the downwardly spring-loaded foot sometimes presses too hard on the pile, before the suction takes effect to retract the foot. In such cases air is squeezed out of the top of the pile, impairing separation as with a cut-off rod.

A third type of suction foot, sometimes called a "sheet seeker", has been previously found only on large presses, and has been used almost exclusively for forwarding. In addition, the sheet-seeker type has been used only to support a sheet from generally the center of the sheet (relative to the direction of feed), rather than from the leading edge. Finally, sheet seekers have been used only in "stream feeding" systems—systems in which successive sheets are overlapped for travel into the rollers of the press, rather than being strictly consecutive as in a pure "sheet feeding" system.

Except for these severe limitations in application, the sheet-seeker foot operates very well. It too has a cylinder, spring-loaded hollow piston and piston rod, and suction-system attachment. The spring-loading, however, is upward rather than downward, and the suction-system connection point is not through the top support rod but rather by means of an external port partway down the side wall of the cylinder.

Thus the force relationships are reversed: it is the suction system (aided by gravity) that extends the suction tip downward toward the sheet, by drawing downwardly on the underside of the piston; and it is the spring that retracts the tip after the sheet is engaged. In this system there is a very fine pilot-pressure hole drilled radially through the piston-rod wallp—so that, when a sheet closes the bottom of the hollow piston rod, air is removed from the central hollow, equalizing the forces on the top and bottom of the piston. In some cases the same effect may be obtained by relying on leakage around the piston. The suction effect on the piston is thereby neutralized, and the spring drives the piston upward to retract the tip with the suspended sheet.

This operation has been found to be excellent, and sheet-seeking feet consequently are becoming generally standard on large presses—but, as previously mentioned only for center-of-sheet support and stream feed. They have not been used, even in large presses, for leading-edge support or sheet feed. Moreover, they have been only negligibly used for separation—as, for example, in certain Miehle units where there is a small amount of vertical motion and a large amount of horizontal motion.

The reason for nonuse of sheet seekers in small presses is fairly clear: prior sheet-seeker feet have been large, and their suction lines protruding from the sides of the cylinders have made them entirely impractical for small presses. By "small" I refer to presses capable of printing sheets no larger than, roughly fourteen by eighteen inches (roughly thirty-five by forty-five centimeters).

Many small presses such as the ATF Chief are particularly designed for (and particularly effective with) leading-edge sheet-feed forwarding. There would be inadequate room for the cylinder of a conventional sheet sucker, not to mention a forward-extending suction hose, anywhere near the leading edge of a sheet that is being individually (i. e., sheet-feed) forwarded. It will be understood that in stream feeding the leading edge of each sheet is carried into the press proper by its central or rearward portions. Consequently the suction foot need not move as far forward toward the pullout rollers and related hardware, and there is a lesser problem of clearances.

Even if the bulkiness of the cylinder could be overcome, prior sheet-seekers would still be extremely problematical in most or all small presses because of the suction line placement. For definiteness in the following discussion of clearances, the ATF Chief will be used as a point of reference. It will be understood, however, that the clearance problems as described are merely exemplary of analogous problems to be found in small presses generally.

If the suction line were extended forwardly from the cylinder wall, it would drag on the lower pullout roller or in some other way—as already suggested—aggravate the leading-edge clearance problem. If the suction lines for a pair of sheet-seeker feet were extended laterally "outward" (toward the side walls of the press) there would be a problem of clearing the side guides when small pieces of stock were being printed. There would be a problem of clearing the side walls, and related hardware there, when fairly large pieces of stock (approaching the lateral size capacity of the machine) were being printed.

On the other hand, if the lines for a pair of sheet seekers were extended laterally "inward" (toward each other), then there would be mutual interference, and interference with the upper pullout roller in many cases, for relatively small pieces of stock (such as envelopes and small announcements). If the lines were extended rearwardly—paralleling the direction of feed—there would be interference with the pile-height sensor, and/or with the transverse shaft that supports the side and rear guides.

The upshot of this discussion will be a realization that in a small press the suction hoses for even a slimmed-down version of the prior-art sheet seekers would have to be custom-rerouted for each job. For many jobs different hose lengths would have to be custom-installed. This kind of added chore would be an extreme aggravation to the pressman, and for competitive short-run commercial work would be totally uneconomical.

Furthermore, some small presses such as the AB Dick or Ryobi have suction feet that are a screw-in type. These are cut-off rods that thread into a hollow transverse bar, which supplies the suction at the top of the rods. Conventional sheet-seeker feet, with their lateral suction nipples, could not be mounted without custom modifications to the press.

It is not entirely clear to me why sheet-seeker feet have not been used in large presses for leading-edge support or sheet feed, or more extensively than they for separation, since many of the problems mentioned above would be alleviated by the more-ample clearances available in larger presses. I believe, however, that the reason is a combination of (1) the very awkward bulk of the conventional sheet-seeker configuration—particularly as to the hose-routing problem—and (2) the compound motion that is imparted to a suction foot when it is used for separation and forwarding in combination.

Restriction of the benefits of the sheet-seeker format to forwarding is very unfortunate. It is true that they are beneficial in forwarding because they are much less likely to drag on return, but sheet seekers are also particularly useful in separation. If they are not used, other types of suction foot must be used in tandem with the forwarding sheet seekers, to raise the sheets into engagement with the sheet seekers.

Such conventional cut-off rods or compensating suckers, in tandem with the sheet seekers, have all the previously enumerated disadvantages of damaging the stock or marring the finished work. These drawbacks are here compounded, however, by the big-business, high-pressure psychological environment that goes with operating the larger, more expensive equipment with its higher overhead.

Restriction of the benefits of the sheet-seeker format to center-of-sheet suspension is also undesirable, in comparison with leading-edge suspension, for the following reasons. In some multipass (e. g., multicolor) printing jobs, when the foot picks up the sheet in the printed area, incompletely dried ink tends to collect on the suction foot. This ink is then transferred to other sheets, marring the finished product. In other cases, spray powder that is used to hasten drying can collect on the suction foot, and be carried into the press—and thus into contact with the printing surfaces (e. g., the "blanket" in an offset lithographic press). Of course the powder interferes with the printing process, producing a ring pattern of the spray powder on the printed piece—but it can also interfere with the inking process, and on long runs the result can be a full-blown mess.

Finally, restriction of the sheet-seeker foot to stream feed is regrettable since accurate, positive feed can be obtained more economically in more modest presses that are designed for sheet feeding. Even the large presses that are sheet fed—such as one Heidelberg unit—do not use sheet-seeker feet.

Prior-art sheet seekers offer excellent performance relative to other suction-foot types; however, all the characteristics that make them incompatible with small presses, with separation, with leading-edge support, and with sheet feed, are serious disadvantages.

SUMMARY OF THE DISCLOSURE

My invention provides a sheet-seeking suction foot for combined sheet separation and forwarding, in a small printing press with a suction system.

The suction foot includes a cylinder with a side wall and a closed upper end, defining a cavity. The cylinder also has a constricted aperture at its lower end.

The suction foot of my invention also includes a piston that is closely fitted within the cylinder cavity, and that has a downwardly extending piston rod or shank. This shank is closely fitted within—and protrudes downwardly through—the aperture. The suction foot also includes a first air passage defined through the piston and shank.

Also part of the invention is a support rod extending upwardly from the closed upper end of the cylinder and adapted for mechanical attachment to the press. The support rod defines within it a second air passage, which is adapted for connection above the top of the cylinder to the suction system. This second air passage extends downwardly from the support rod into the closed upper end of the cylinder. For presses with screw-in feet as standard equipment, the support rod of my invention is simply cut to the correct length and threaded.

My invention also includes some means for communication between the cylinder cavity, below the piston, and the second air passage just mentioned. For purposes of speaking generally, these means for communication will be called the "air-passage means". The air-passage means are defined at least partially within the side wall of the cylinder.

In certain preferred embodiments of my invention, the air-passage means include (1) at least two individual fine axial passages within the side wall of the cylinder, and generally parallel to an axis of the cylinder; and (b) a corresponding number of individual fine radial passages within the side wall of the cylinder and at a point below the piston. These individual small radial passages communicate between respective axial passages and the cylindrical cavity.

In addition, in certain preferred embodiments the support rod is generally centrally disposed with respect to the upper end of the cylinder; and the air-passage means further include an additional corresponding number of individual fine radial passages within the closed upper end of the cylinder. These upper passages communicate between respective axial passages and the "second air passage" mentioned earlier.

Thus it will be understood that the fine air passages bored through the cylinder side walls and top wall serve to carry the suction effect that is applied to the hollow support rod down through the cylinder walls to a point below the piston. In this way the piston is pulled downwardly by the suction, but there is no port or nipple protruding and no hose horizontally extending from the side wall of the cylinder.

I prefer to provide at least four sets of axial and radial passages, since I have found that a smaller number is not adequate for a good suction effect at the tip of the device.

I also prefer to shape the cylinder wall externally to define two opposed very thin wall segments, each adapted for close juxtaposition of the center of the cylinder to other components within the press. The remaining segments of the cylinder wall are externally shaped to define two opposed relatively thick wall segments, to accommodate the radial and axial passages—or other air-passage means.

My invention also encompasses the combination of the suction foot, as above described, with a small printing press that has a suction system. In this combination the support rod is mechanically attached to the press so as to engage the top of a pile of sheets very near the front edge of each sheet. In this combination the second air passage is connected above the top of the cylinder to the suction system of the press.

The support rod is also mechanically actuated by the press mechanism so as to move the suction foot vertically as well as forward and back, and thereby to separate each sheet in turn and forward that sheet into the press for printing—in other words, to do both separation and forwarding. Finally, I prefer to use mechanisms that produce full sheet feeding as distinct from stream feeding.

All of the foregoing operational principles and advantages of the present invention will be more fully appreciated upon consideration of the following detailed description, with reference to the appended drawings, of which:

BRIEF DESCRIPTION OF THE DRAWINGS

(FIGS. 5 and 6 also both include section lines 4—4 along which FIG. 4 is taken.)

DETAILED DESCRIPTION OF PREFERRED EMBODIMENTS

Figure 1:
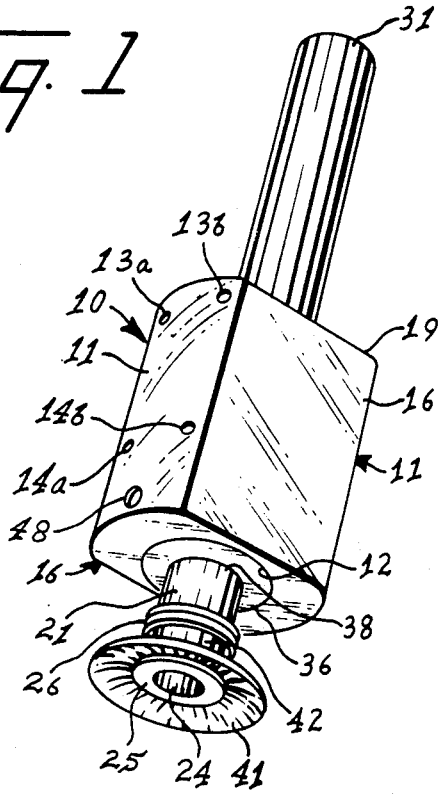
FIG. 1 is an exterior perspective view of a sheet-seeking suction foot that is a preferred embodiment of my invention, taken from slightly below the article.

As shown in FIG. 1, my invention has a cylinder 10 that has preferably been made from a cylindrical piece of metal such as aluminum. Its outer surface is still partially cylindrical at two opposing sides as at 11, but to improve clearances has been cut off along two opposing sides to form planar surfaces 16.

The upper end of the cylinder 10 is unitary with a support rod 31, which extends upwardly from the top 19 of the cylinder 10. Visible in FIG. 1 are four small holes 13*a*, 13*b* 14*a* and 14*b* drilled into the portion of the wall that is still cylindrical—two near the top of the cylinder and two near the center (vertically). The outer ends of these holes are plugged. The purpose of these holes will shortly become clear.

The cylinder 10 is hollow, having a cylindrical cavity within it, and fitted within this cavity is a bushing 36 whose bottom surface may be generally flush with the bottom of the cylinder. The bushing 36, advantageously of metal, is held in place by a set screw that is threaded into a tapped hole 48 in the cylindrical portion of the cylinder wall.

The bushing 36 creates at the bottom of the cylindrical cavity a constricted aperture 38, through which protrudes downwardly a hollow piston rod or shank 21. The shank is advantageously metal, preferably aluminum. Defined in this shank 21 is a hole 24, which extends the entire length of the shank.

At the bottom end of the shank 21 is a narrow, shallow, circumferential flange 25; and slightly above it is a similar flange 26. Captured between these two flanges is an outwardly and downwardly extending soft rubber hood 41. The hood is stabilized in a conventional manner by a short vertical section 42 that closely surrounds the portion of the shank 21 between the two flanges 25 and 26.

As revealed by FIG. 2, and FIGS. 4 through 6, the piston rod or shank 21 extends upwardly within the cylindrical cavity 12 and terminates in a piston 22. For minimal operating noise and longer life the piston 22 may be made of nonmetallic material such as plastic. To minimize friction the piston 22 may be of Teflon, but other plastics such as Nylon also serve the purpose.

The piston 22 is prevented from riding down the shank by suitable means such as a shoulder (not illustrated) formed near the top of the shank. The piston is held to the top end of the shank 21 by any suitable fastening arrangement, such as peening outwardly the topmost surface of the shank 21 to form a retaining flange 23, somewhat like a rivet head.

Figure 4:
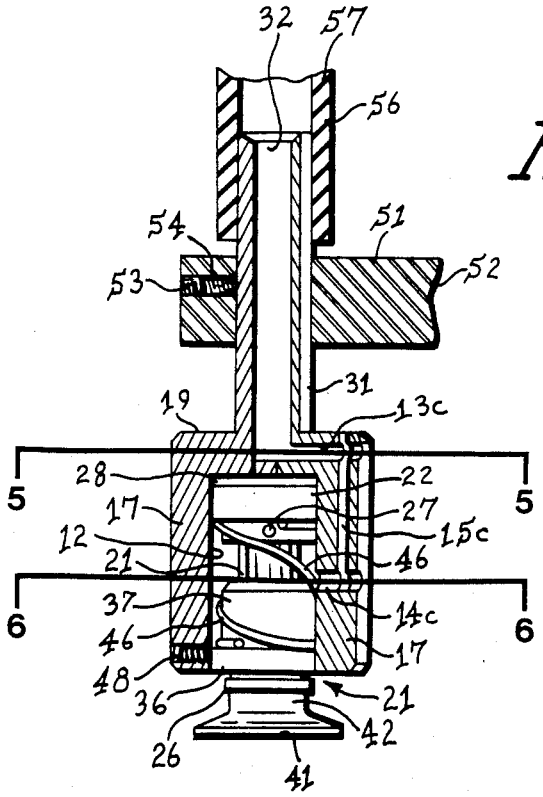
FIG. 4 is an elevation of the FIG. 1 embodiment, also showing the cylinder partially in section, and in addition showing in section typical suction and mechanical-support connections to a printing press (such as that in FIG. 3).

The previously mentioned hole 24 in the shank is continued to the top of the piston 22. This hole 24 thus provides communication between the outside air below the assembly and the internal air space above the top of the piston 22. The upper end of the bushing 36 is turned down radially to form a narrow annular space within the cylindrical cavity 12. Within this narrow space is fitted the lower end of a spring 46, which pushes the piston 22 upward. (As shown in FIG. 4, the lower end of the piston 22 is also turned down radially, creating a similar annular space to receive the upper end of the spring 46.)

The top end of the internal cylindrical cavity 12 does not extend through the top of the cylinder 10, but rather terminates below a top bulkhead 19. Above this bulkhead is the support rod 31, which for strength is advantageously turned down from the same piece of metal stock as the cylinder 10. The support rod 31 too, however, is hollow. Defined in it is a central air passage 32, which extends downwardly below the top surface of the cylinder into the bulkhead 19.

Drilled laterally through the top bulkhead 19 and into the central hole 32 that is extended below the support rod is a small radial passage **13*c*. Intersecting this radial passage 13*c* is a small axial passage 15*c*. This axial passage 15*c* is drilled in the relatively thick portion 17 of the cylinder wall that is provided within the previously mentioned part 11** of the outer surface that has been left cylindrical.

The outer radial end of the radial passage **13*c*, and the upper axial end of the axial passage 15*c* are both plugged, so that the two passages 13*c* and 15*c* in series with the central hole 32** in the support rod form a closed passage from the top of the support rod to a point roughly halfway down the cylinder.

Yet another radial passage **14*c* is drilled through the cylinder wall, also intersecting the axial passage 15*c*, but lower than the previously mentioned radial passage 13*c*. This lower radial passage 14*c* is roughly halfway down the cylinder wall, and so intersects the axial passage 15*c*** at or near the bottom end of that passage.

The outer radial end of the lower radial passage **14*c*, like the outer extremities of the other passages, is plugged; consequently the inside of the cavity 12—very roughly near its midpoint, vertically—is placed in sealed communication with the top end of the hole 32 in the support rod 31**.

Figure 3:
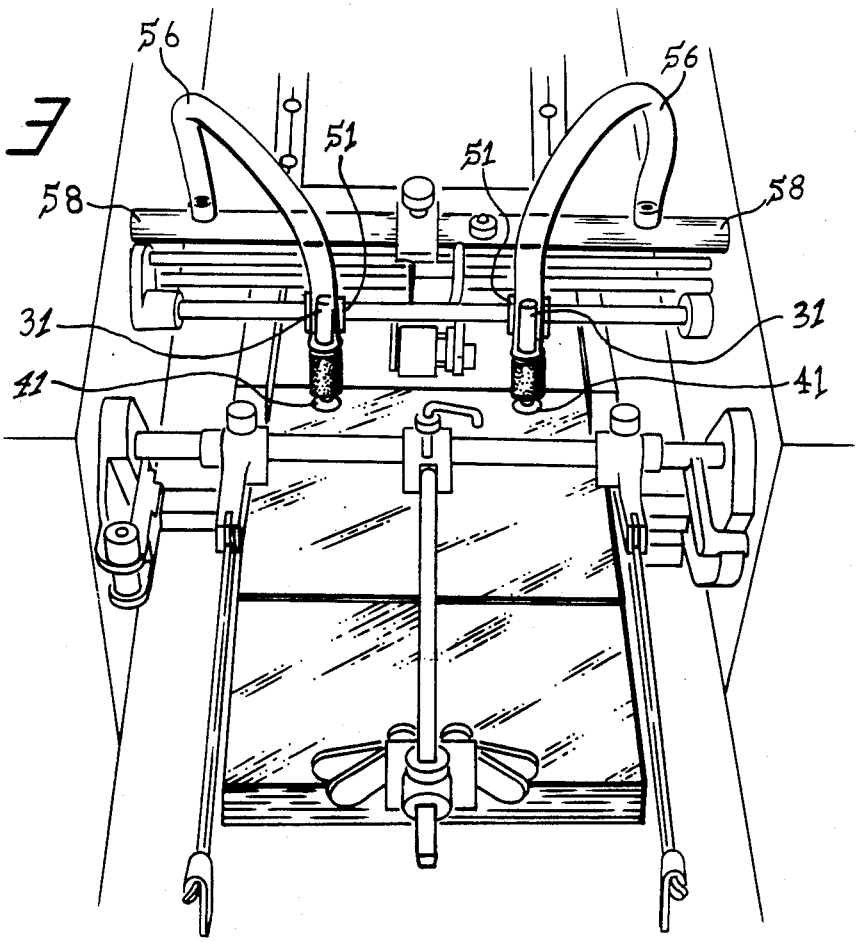
FIG. 3 is a very generalized perspective view of the stock-feed area of a small printing press on which are installed two suction feet that are in accordance with the FIG. 1 embodiment of my invention.

FIG. 3 illustrates that the support rod 31 of each suction foot according to my invention is to be gripped mechanically by a portion 51 of the printing press which imparts suitable motion for feeding paper or card stock. FIG. 3 also shows that a suction tube 56 from a suction bar 58 (which communicates with a pump in the printing press) is connected to the top end of the support rod 32. This setup applies suction to activate the suction foot. As will be shown, when the bottom tip of the foot (and the hood 41) contacts a piece of stock, the suction holds the paper up against the foot.

The part 51 of the press which supplies the mechanical gripping function is also shown in FIG. 4, but in a highly generalized way, and drawn broken away as at 52. A set screw 54 is typically threaded into a tapped hole 53 in the gripping mechanism 51, to secure the support rod 31 to that mechanism. The suction hose 56 is also shown in FIG. 4, but similarly drawn broken away as at 57.

(In some small presses the suction feet are screwed into a motion-imparting suction bar such as appears at 58, so that suction and motion are supplied by the same element. The support rod 31 of my invention is very readily cut to the appropriate length, and appropriately diametered and threaded, to fit into such systems.)

Now in operation the suction at hose 56 is applied through the hole 32 in the support rod, to the upper small radial passage **13*c*, and thence to the small axial passage 15*c*, and thereby finally to the lower small radial passage 14*c*. This suction thus is applied to the space that is (1) defined radially between the interior wall of the cylindrical cavity 12 and the outer surface of the shank 21, and (2) defined axially between the top of the fixed bushing 36 and the bottom of the piston 22**.

Since the piston is movable, the applied suction tends to draw the piston downwardly against the action of the spring 46, causing the shank 21 to move downwardly from its retracted position (FIGS. 2 and 4) to an extended position (FIG. 1).

If the bottom tip of the shank, with its rubber boot 41, is now brought into contact with a sheet of stock, the degree of force associated with the contact depends not only upon the relative velocity of the support rod and the pile of stock—but also upon the effective suction force at the underside of the piston 22, in comparison with the strength of the spring 46, and to a lesser degree the force of gravity on the piston 22 and shank 21.

The forcibleness of the contact is very readily made slight, by suitable choice of various dimensions such as the diameters of the piston 22, the shank 21, and the small axial and radial passages 13*c*, 14*c* and 15*c*. Increasing the difference between the two first-mentioned of these diameters has the effect of making the annular area of the piston larger, which increases the downward force with which the shank 21 is held extended. Making the diameters of the passages 13*c*, 14*c* and 15*c* larger does likewise.

Once the foot is in contact with the stock, of course, it is desirable to apply the suction from the hose 56, through the various passages previously mentioned, to the upper surface of the top sheet of stock. This is accomplished by providing very slight suction leakage around or through the piston 22. In some cases appropriate leakage can be achieved merely by suitable selection of clearance between the outer cylindrical surface of the piston 22 and the inner cylindrical surface of the cavity 12. I prefer, however, to control the leakage more closely by providing a very fine pilot hole 27 through the shank 21 and/or the piston 22.

The suction loss through the pilot hole 27 is not enough to impair the downward extension of the boot 41 under the influence of the suction system. When the boot 41 contacts a sheet of stock, however, the suction system removes air within the cavity 24 in the shank 21, through the pilot hole 27. This air removal is enough to apply effective suction to the sheet of stock below the tip of the foot; in other words, the suction is strong enough to hold the stock up against the foot.

Furthermore, once the stock closes the bottom of the hole 24 in the shank 21, the air pressure within that hole 24—and thus the pressure in the air space 28 above the piston 22—promptly falls to very nearly the same value as the pressure within the annular cavity below the piston 22. The effect of suction on the annular or peripheral portion of the piston 22 is therefore neutralized. The spring 46, in cooperation with the suction on the central part of the piston 22 (including the part effectively provided by the sheet of stock across the hole 24 in the shank 21), raises the piston 22—and with it the shank 21, the boot 41, and the sheet of stock.

As a practical matter I find the shapes and dimensions of the preferred embodiment rather "fussy". The exterior clearances in the various small printing presses are often very small. For some particular types of press they may not be small in general, but they are certainly small under particular circumstances such as when printing short stock, or narrow stock, or wide stock.

To make a pressure foot that is commercially practical, it is necessary to make one that is usable in virtually all such cases. This means it is essential to make the exterior of the foot as small as possible. On the other hand, it is crucial to apply sufficient suction to (1) effectively extend the shank 21, and to (2) reliably, affirmatively hold each sheet of stock against the bottom tip of the shank while the stock is lifted from the pile.

In practice I have found that the above-described single series of small passages 13*c*, 14*c* and 15*c*, in combination with the single pilot hole 27, is only marginally sufficient to meet these requirements in enough of the many small-printing-press environments to be commercially practical.

Of course the number of passages and pilot holes cannot be sensibly considered alone. The number of such passages and holes is interrelated with the diameter of each passage and pilot hole, and with the external dimensions of the overall device. As already explained, however, it is desirable to keep the external dimensions very compact, and therefore the diameters of the passages and pilot holes must be quite small. Accordingly after very extensive effort I have settled on a preferred embodiment that has four such sets of small axial and radial passages, and four such pilot holes.

Figure 2:
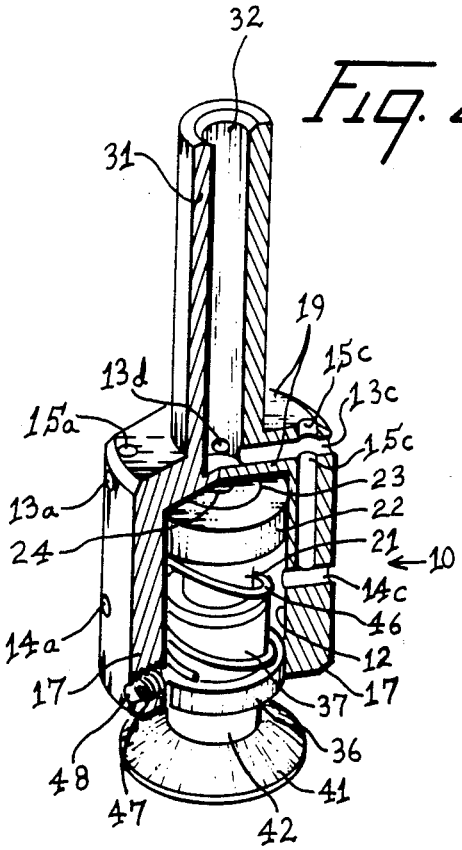
FIG. 2 is an isometric view of the same embodiment, taken from slightly above the article, with the cylinder drawn partially in section to show the interior components and features.
Figure 5:
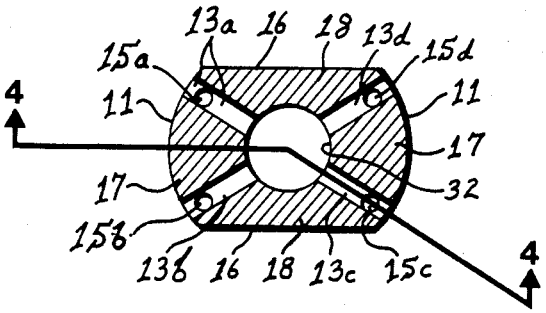
FIGS. 5 and 6 are sectional plans of the upper and central portions of the cylinder, taken respectively along lines 5—5 and 6—6 of FIG. 4.
Figure 6:
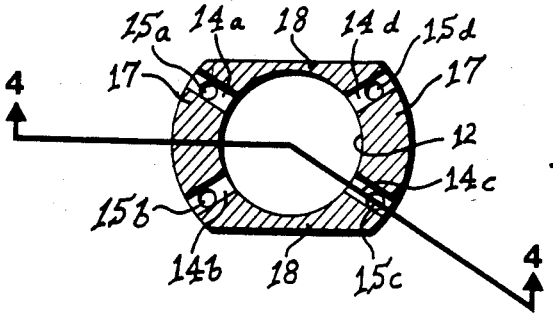

Two radial passages mentioned earlier are visible in FIG. 1 (and some of them in FIG. 2)—namely, the upper radial passages 13*a* and 13*b*, and lower radial passages 14*a* and 14*b*. In FIG. 2 another axial passage 15*a* and another radial passage 13*d* are also visible. FIGS. 5 and 6 illustrate the full complement of small axial and radial passages 13*a* through 13*d*, 14*a* through 14*d*, and 15*a* through 15*d*.

As illustrated, all the small axial and radial passages 13*a* through 15*d* are drilled through the relatively thick wall segments 17 of the cylinder 10, formed by the cylindrical portions 11 of the wall. Yet excellent exterior clearances are obtained at the two opposed very thin wall segments 18 formed by the planar-cutaway surfaces 16.

As to the pilot holes, the hole 27 appearing in FIG. 4 is continued entirely through the piston 22 and shank 21, so that it passes through both of the diametrally opposed walls of the piston and shank, forming two pilot holes. Another identical diametral hole (not illustrated) is also drilled entirely through the piston 22 and shank 21 at right angles to the first hole 27, to form two more pilot holes.

To place these configurations in perspective, and also to provide a disclosure fully adequate to permit practice of my invention by a person skilled in the general art of mechanical devices at the level of a technician or even a machinist, tne preferred embodiment of my invention is made with these dimensions, in inches:

0.99 diameter of the cylindrical portion of the outside wall of the cylinder, as measured across two opposing cylindrical surfaces 11;
0.70 thickness of the planar-cutaway portion of the outside wall of the cylinder, as measured across two opposing planar surfaces 16;
1.12 height of the cylinder block 10;
0.56 inside diameter of the cylindrical cavity 12;
0.99 axial depth of the cylindrical cavity 12;
0.38 outside diameter of the support rod 31;
0.22 inside diameter of the hole 32 in the support rod 31;
1.64 length of the support rod 31;
1.75 axial depth of the hole 32 in the support rod 31, to the bottom of the intersecting upper radial passages;
0.09 diameter of each axial or radial passage 13*a* through 15*d*;
0.31 outside diameter of the shank 21;
0.20 inside diameter of the shank 21;
1.19 overall length of the shank 21, including the section within the piston 22;
0.55 outside diameter of the piston 22;
0.06 inside diameter of each pilot hole 27; and
0.56 outside diameter of the bushing 26.

The appropriate strength of the spring 46 will vary from one press type to another, in dependence upon the strength of the associated suction system. For the ATF Chief, I have found satisfactory a spring that provides a force of approximately 0.3 ounce when the piston rod 21 is fully retracted, and a force of approximately 0.5 ounce when the piston rod 21 is fully extended. Such a spring is sufficient to lift the weight of the piston 22 and piston rod 21 (roughly 0.1 ounce), and with them the weight of half the leading edge of virtually any stock that will go through the press.

I have found that in operation my invention makes it possible for an ATF Chief press to feed any stock from very light onionskin to chipboard, without need for the slightest adjustment in suction or in pile position. In fact, it is possible to place on the stock elevator a pile containing stock of all such weights and types mixed together, and a press fitted with suction feet made as prescribed above will reliably and positively feed each piece of stock in the pile. This capability has been publicly demonstrated to professional printers, using my invention on an otherwise completely standard, typical small printing press without any type of special setup or accommodation—of either the peculiar mix of stock or the suction foot itself. Personnel familiar with the normal operating performance of such presses found this demonstration both very unusual and, literally, very surprising. In fact they reacted uniformly: they were astounded.

It is to be understood that all of the foregoing detailed descriptions are by way of example only, and not to be taken as limiting the scope of my invention—which is expressed only in the appended claims.

I claim:

1. A sheet-seeking suction foot for combined sheet separation and forwarding, and having a unitary construction and lobe-type configuration particularly adapted for compactness and for compatibility with any of a variety of small printing presses that have suction systems, said suction foot comprising:

a cylinder having a unitary circumferential wall; and having a closed upper end to define a cavity, and having a constricted aperture at its lower end; said wall being externally shaped to define:

two opposed very thin wall segments, each adapted for close juxtaposition of the center of the cylinder to other components within the press; and two opposed relatively very thick wall lobes generally disposed at right angles to the thin wall segments;

a piston closely fitted within the cylinder cavity and having a downwardly extending shank that is closely fitted within and protrudes downwardly through the aperture; and a first air passage defined through the piston and shank, said air passage being sealed against communication with ambient except through the extreme bottom end of the shank, and being free of lateral passageways below the portion of the shank that is always within the cylinder;

a support rod extending upwardly from and generally centrally disposed with respect to the closed upper end of the cylinder, adapted for mechanical attachment to such press and defining a second air passage adapted for connection above the top of the cylinder to such suction system, said second air passage extending downwardly from the support rod into the closed upper end of the cylinder; and air-passage means for communication between the cylinder cavity below the piston and the second air passage, said air-passage means being defined entirely within the closed upper end of the cylinder and the wall lobes, and including:

a plurality of individual very small drilled axial passage mutually spaced apart within each of the lobes and generally parallel to an axis of the cylinder, a corresponding plurality of individual small lateral passages within each of the lobes at a point that is always below the level of the piston, and communicating between respective axial passages and the cylindrical cavity, and a further corresponding plurality of individual small lateral passages within the closed upper end of the cylinder and communicating between respective axial passages and the second air passage;

and such lobe-type configuration, as particularly provided by the two opposed thick wall lobes in combination with the two opposed very thin wall segments, causing the sheet-seeking suction foot to be compatible with any one of a variety of small commercial printing presses.

2. The suction foot of claim 1, in combination with such small printing press that has a suction system, and wherein:

the support rod is mechanically attached to the press so as to engage the top of a stack of sheets very near the front edge thereof, and to separate the one sheet from the top of a stack of sheets and forward such one sheet into the press for printing; and the second air passage is connected above the top of the cylinder to the suction system of the press.

3. The suction foot of claim 1, wherein:

the wall lobes are externally configured as two diametrically opposed right-circular cylindrical segments terminated in common by two generally planar, generally mutually parallel surfaces;

the thin wall segments are externally configured as said two generally planar, generally mutually parallel surfaces;

the generally planar surfaces intersect the cylindrical segments to form generally vertical corners; and the axial passageways include four passageways, each being defined near a respective generally vertical corner formed by intersection of one of the generally cylindrical segments with one of the generally parallel surfaces.

4. The suction foot of claim 3, wherein:

the cylindrical segments of the cylinder wall considered together are approximately one inch in diameter;

the two generally planar surfaces are approximately seven-tenths inch apart;

the cylinder, including its closed upper end, is approximately one and one-eighth inch tall; and the cavity is approximately nine-sixteenths inch in inside diameter and approximately one inch deep.

5. The suction foot of claim 4, wherein:

the support rod is approximately three-eighths inch in outside diameter; and the first air passage in the support rod is approximately seven-thirty-seconds inch in inside diameter.

6. The suction foot of claim 4, wherein the piston is made of a material selected from the group consisting of:

a first material available commercially under the trade name "Nylon";

a second material available commercially under the trade name "Teflon";

any material equivalent to the first material; and any material equivalent to the second material.

7. The suction foot of claim 6:

also comprising a spring mounted around the shank, between the piston and the lower end of the cavity, said spring being:

larger in diameter than the aperture at the lower end of the cavity, retained within the cavity above the constricted aperture, and adapted to tend to urge the piston upwardly within the cavity; and wherein:

the cavity, piston and shank together form an enclosed annular volume below the piston;

in operation, the annular volume is sealed against communication with ambient except through the first air passage;

the sealing of the annular volume except through the first air passage precludes application of atmospheric pressure to raise the piston; and the piston is raised substantially solely by the effect of the spring.

* * * * *